United States Patent [19]

Stewart et al.

[11] 4,070,558

[45] Jan. 24, 1978

[54] HIGH VOLTAGE CIRCUIT-INTERRUPTERS

[75] Inventors: John Stanley Stewart, Gateshead; Peter Headley, North Shields, both of England

[73] Assignee: Reyrolle Parsons Limited, Newcastle-upon-Tyne, England

[21] Appl. No.: 621,515

[22] Filed: Oct. 10, 1975

[30] Foreign Application Priority Data

Oct. 11, 1974 United Kingdom ..... 44231/74

[51] Int. Cl.[2] ..... H01H 33/70

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 3,769,479 | 10/1973 | Leeds | 200/148 A |
| 3,839,613 | 10/1974 | Tsubaki et al. | 200/148 A |

*Primary Examiner*—Robert S. Macon

*Attorney, Agent, or Firm*—Watson, Cole, Grindle & Watson

[57] ABSTRACT

A high-voltage circuit-interrupter for operation in an insulating gas or liquid contained in an enclosure, comprises a generally tubular movable contact assembly mounted for movement relatively to a tubular fixed contact to draw an arc between them. The movable contact assembly comprises a tubular main contact carrying a nozzle and having a relatively-axially-movable auxiliary contact in its interior. A puffer cylinder-and-piston device is arranged to direct a flow of the insulating fluid under pressure through the nozzle and thence into the interiors of the fixed contact and the movable contact assembly through the gap between them on operation of the circuit-breaker. The auxiliary contact is arranged to move relatively to the main contact of the movable contact assembly during the opening stroke of the interrupter and to open a vent valve to allow a part of the fluid flow which has passed through the gap between the separated contact to vent through a radial passage extending through the movable contact assembly, the remainder of the fluid flow being vented through the bore of the tubular fixed contact.

6 Claims, 3 Drawing Figures

HIGH VOLTAGE CIRCUIT-INTERRUPTERS

This invention relates to high voltage circuit-interrupters of the type for operation within an enclosure containing an insulating fluid medium, which may be gas or liquid, and is particularly, although not exclusively, applicable to the type of circuit-breaker which comprises a sealed vessel housing one or more interrupter units witin the insulating medium, which for example may be $SF_6$ gas under pressure, in the vessel.

An object of this invention is to provide an improved construction of the interrupter of the type specified which is simple and efficient in operation and economical in space and manufacture.

According to the present invention an interrupter of the type specified comprises a first contact assembly movable relatively to a cooperating tubular second contact, wherein the first contact assembly includes a main electrical contact, an auxiliary contact and an insulating nozzle for directing a flow of the fluid medium through the gap between the separated first contact assembly and second contact and onto an arc drawn between them on operation of the circuit-breaker, means being provided for delivering fluid under pressure to the nozzle on operation of the circuit-breaker to create the said fluid flow, and in which, during the circuit-opening stroke of the interrupter, the auxiliary contact is arranged to move relatively to the main contact in such a way that, in addition to carrying the current, the auxiliary contact operates valve means for diverting part of the fluid flow which has passed through the said gap to vent through a radial passage in the moving contact assembly, another part of the fluid flow which has passed through the gap escaping through the bore of the tubular second contact.

Preferably the tubular second contact is fixed and the first contact assembly is movable.

The means for delivering fluid under pressure to the nozzle may comprise a puffer device of piston-and-cylinder type, whereof the puffer cylinder is secured to the nozzle to deliver fluid under pressure into the nozzle and the puffer piston is fixed, the main contact of the first contact assembly being secured to the puffer cylinder and nozzle for movement therewith.

In a preferred arrangement the current path through the interrupter when in the closed position is from the second contact to the main contact and thence to the puffer cylinder. During an initial stage of the opening stroke the current path is from the second contact to the auxiliary contact, and thence via the main contact in parallel with the auxiliary contact to the puffer cylinder.

Preferably the auxiliary contact forms the valve means. It may comprise a generally cylindrical body having a radially-open port in its wall, said radially-open port coming into alignment with the radial vent passage in the moving contact assembly.

The auxiliary contact preferably includes a relatively-fixed rooting electrode for transfer of the arc during the circuit-opening stroke of the interrupter. The auxiliary contact may also include deflector means for directing the flow of insulating medium into the radial-opening ports.

The invention may be carried into practice in various ways, but one specific embodiment of the invention will now be described, by way of example only, with reference to the accompanying drawings, in which.

Figure 1:
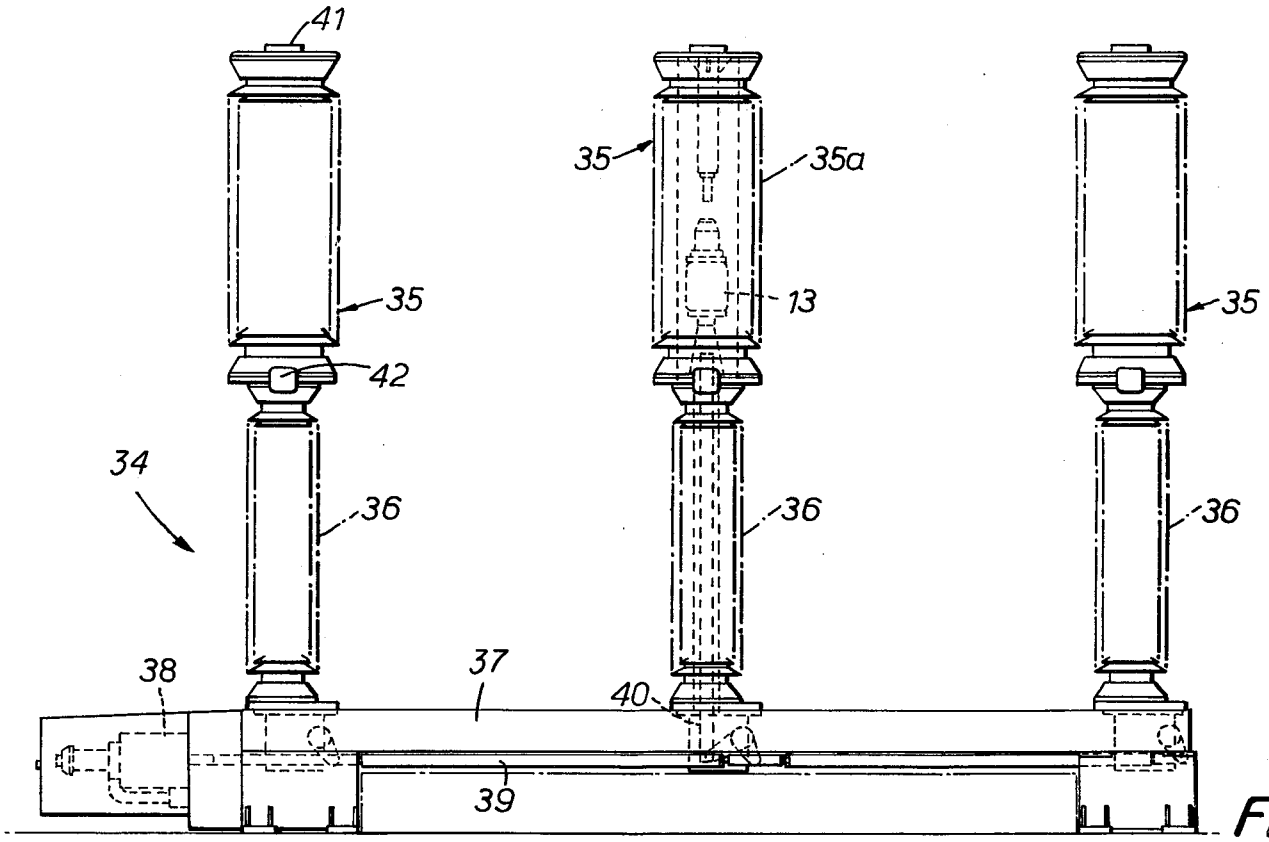
FIG. 1 illustrates diagrammatically a sectional side view of a three-phase high-voltage circuit-breaker having interrupter units embodying the invention.
Figure 2:
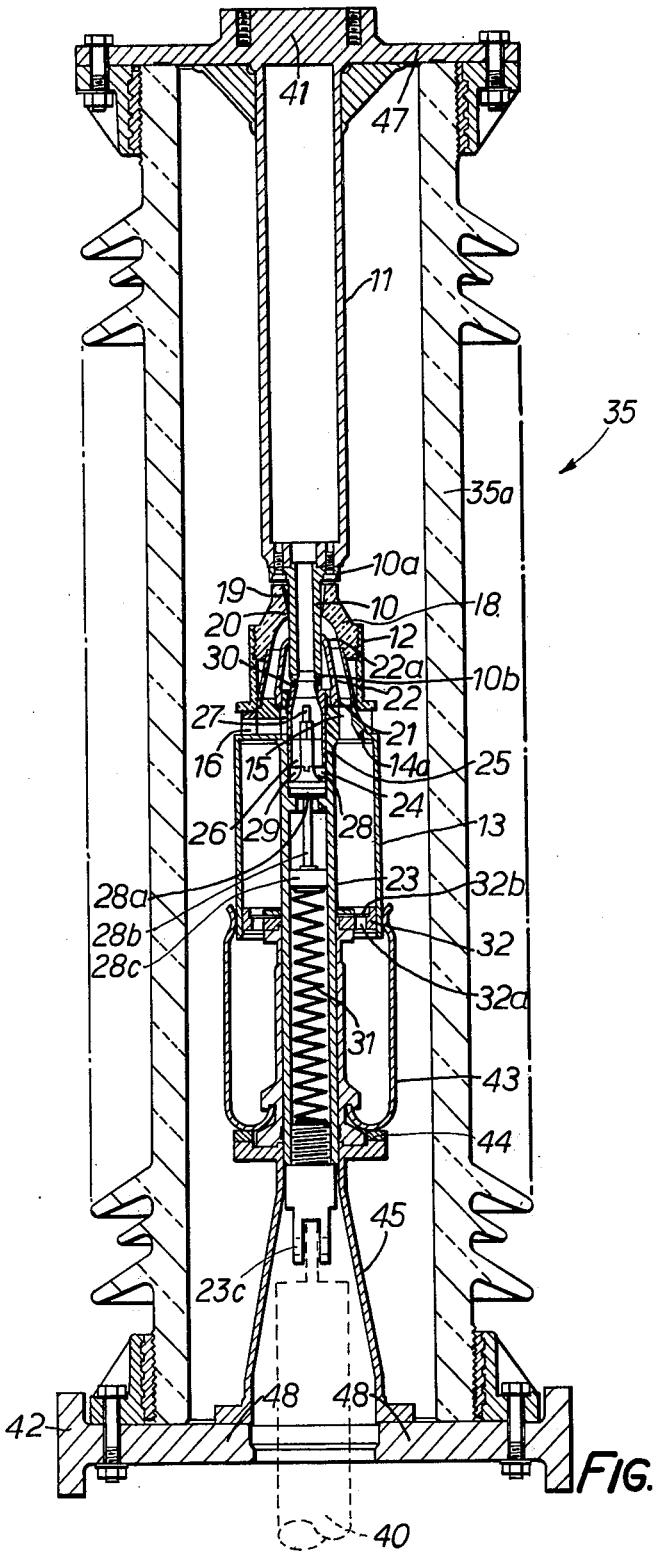
FIG. 2 shows in greater detail one construction of one of the interrupter units of the circuit-breaker of FIG. 1, shown in the circuit-closed position.
Figure 3:
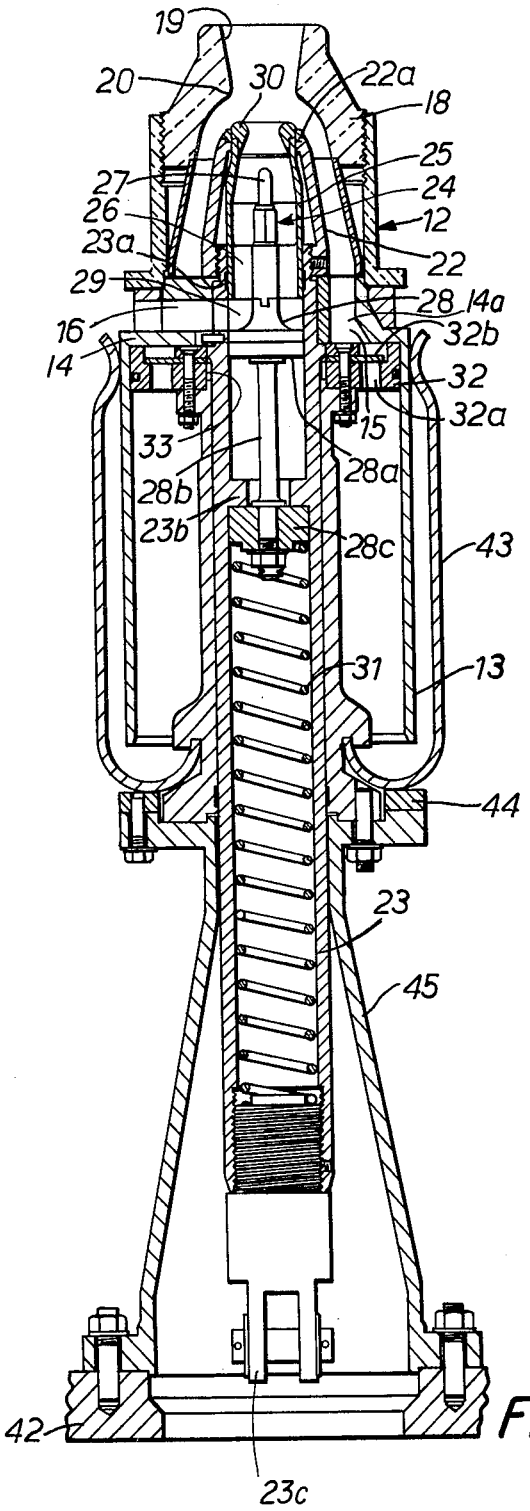
FIG. 3 is a view on a larger scale of the movable contact assembly of the interrupter unit of FIG. 2, but with the interrupter in the circuit-open position.

In the embodiment shown in FIGS. 1 to 3, a high-voltage circuit-breaker 34 comprises three vertically-mounted interrupter units 35 fixed on insulator pedestals 36 on a metal frame 37 and coupled to a common operating mechanism 38 via an operating rod 39 and individual pull rods 40 connected to each interrupter. One phase of a three-phase electrical circuit is connected to terminals 41 and 42 of each interrupter. The centre phase of FIG. 1 shows in outline form the interior of an individual interrupter unit 35 which is shown in greater detail in FIGS. 2 and 3.

Each interrupter 35 comprises a shedded insulating tube **35*a* with end flanges 47, 48 whose interior contains $SF_6$ gas at a low superatmospheric pressure, mounted within which tube is a contact assembly comprising a fixed tubular contact 10 which is retained on a vented housing 11 by a flanged portion 10*a* of the contact 10 and is electrically connected via housing 11 to an associated terminal 47 of the interrupter. As shown in FIG. 2 the fixed contact 10 is surrounded, when the interrupter is closed, by a movable contact assembly indicated generally at 12. The movable contact assembly 12 comprises a puffer cylinder 13 made of a conducting material such as copper or copper alloy in electrical connection with the other terminal of the interrupter, via transfer contacts 43, a contact ring 44, and a fixed support pedestal 45. The electrical circuit from the puffer cylinder 13 is continued through a ported end wall 14 of the puffer cylinder, the end wall 14 being provided with a spigot 14*a* with axial passages 15, four in number and also with four radially-extending vent passages 16. The axial and radial passages 15 and 16 are spaced around the end wall 14 but do not connect with one another. The spigot 14*a* protrude from end wall 14, and carries, carried an insulating nozzle 18 made of a suitable material such as p.t.f.e. The nozzle 18 is provided with a divergent bore 19 having to a throat 20 which is a close fit over the fixed contact 10**.

As shown best in FIG. 3, a finger contact member is fixed into a central bore in the end wall 14 of the puffer cylinder and comprises a cylindrical body having at one end a screwed cylindrical end portion 21 which fits into the end wall 14, and a tapered portion 22 of reduced cross-section in which axial slits are cut to form a cluster of resilient finger contacts. The tips **22*a* of the finger contacts are in a circular formation and can surround the fixed contact 10** in sliding engagement with it to establish electrical contact therewith.

A hollow driving tube 23 is fixed at one end **23*a* to the end portion 21 of the finger contact member and at the other end has a yoke 23*c* secured to the respective operating pull rod 40 as shown in FIGS. 1 and 2, and its bore at the upper end in FIGS. 2 and 3 contains a close-fitting slidable auxiliary nozzle contact assembly generally indicated at 24. The auxiliary nozzle contact assembly 24 comprises an open-ended cylinder tube 25 within the bore of which is a support spider 26. Into this support spider 26 is screwed an assembly comprising a rooting electrode 27 and a deflector stub 28. The lower end of the cylinder tube 25 is sealed off by the end of the deflector stub 28, but the cylinder wall is provided with a circumferential slot 29 positioned between the deflector stub 28 and the spider 26, the slot 29 being of a dimension such as to span the radial vents 16 when the assembly 24 is in the position shown in FIG. 3. The auxiliary contact assembly is guided in the driving tube 23 by means of an insulating bearing pad 28***a* and 23*a* an insulating bearing ring at and is spring-biased towards its limit position shown in FIG. 3 by a spring 31 housed within the drive tube 23 and bearing on the rear face of the deflector stub 28 via a connecting rod 28*b* and bearing piston 28*c* . A step 23*b* inside tube 23 limits the amount of travel of the cylinder tube 25 to prevent distortion of tapered portion 22*a* of the finger contact member.

At the outer end of the cylinder tube 25 there is provided an arc-resistant conducting nozzle 30, which as shown in FIG. 2 can come into electrical butt contact with an arc-resistant ring 10*b* on the tip of the fixed contact 10.

The puffer cylinder 13 houses a close-fitting fixed puffer piston 32 having vent holes 32*a* covered by flap valves 32*b*, and the drive tube 23 passes through a close-fitting central bore 33 in the piston 32. The puffer cylinder 13 at its end nearest to the fixed contact 10 and contact movable nozzle 18 is fixed to the drive tube 23 for longitudinal movement therewith by the circuit-breaker operating mechanisms 38, 39, 40.

Operation of the interrupter to break an A.C. power circuit will now be described with reference to the accompanying drawings.

In FIG. 2 the circuit-closed position is shown, and the power current path is from the terminal 42 and pedestal 45 to the movable contact assembly 12 via the puffer cylinder walls 13, 14 and the cluster contact member 21, 22 to the fixed contact 10 and thence to the housing 11 and terminal 44. The pressure of the $SF_6$ gas on the outside of the puffer cylinder 13 is substantially the same as that within the cylinder 13 and surrounding the fixed and moving contact assemblies. The operating mechanism, 38, 39, 40 is actuated to drive the tube 23 and puffer cylinder 13 downwardly in FIG. 2, so that the gas within cylinder 13 is compressed against the fixed piston 32 to a higher pressure than that surrounding the cylinder 13. The higher pressure builds up in the gas passages 15 and within the region of the contacts but is prevented from escaping to the outside of the assembly 12 by virtue of the close fit between the fixed contact 10 and the nozzle throat 20 and between the auxiliary contact cylinder tube 25 and the bore of the drive tube 23.

As the opening operation continues, the auxiliary contact nozzle 30 maintains electrical contact with the fixed contact 10, due to inertia and the spring-biasing provided by the spring 31, and the cluster contact fingers 22 slide down over the outside face of the fixed contact 10 and past its tip 10*b* until the contacts are in the position just prior to contact separation between 10*b* and 30. At this time since the auxiliary contact nozzle 30 has been held in abutment with the fixed contact 10 by the spring 31, the cluster contact fingers 22 have left the fixed contact 10 and are in firm engagement with the auxiliary contact cylinder tube 25, and the circumferential slot 29 in the cylinder 25 is in alignment with the radial vents 16. Further downward movement of the moving contact assembly 12 draws an arc between the fixed contact arcing ring 10*b* and the auxiliary contact arcing nozzle ring 30, and the pressurised gas can then flow through the axial gas passages 15 and across the arc so formed, passing into the interior of the fixed contact 10 and housing 11 and also passing back through the auxiliary contact cylinder tube 25 to vent radially through the slot 29 and passages 16. At this stage the fixed contact 10 still blocks the throat 20 of the nozzle 18, but further movement unblocks this gas flow path. By this time the arc is driven, by virtue of the electromagnetic field and gas pressure, to stand between the fixed contact 10 and the rooting electrode contact 27. The gas flow and the resulting extension of the arc and the dissipation of energy due to the action of the compressed gas finally lead to arc extinction at an appropriate current zero, with the moving contact assembly 12 at rest as shown in FIG. 3.

Closure of the interrupter is obtained by movement of the moving contact assembly and drive member upwardly in FIG. 3 and gas is quickly drawn into the assemblies by virtue of flap valves 32*b*.

It should be noted that the invention is not restricted to the form of construction shown and many variations in detail may be made.

The auxiliary contact assembly 24 may be used to operate a separate associated valve porting means, instead of or in addition to the means 29, 16. Additional venting through the wall of the insulating nozzle 18 may be provided downstream of its throat 20.

The invention is not restricted to the use of $SF_6$ gas as the insulating fluid medium. The $SF_6$ may be in liquid form, or other gas or fluid medium may be used.

Furthermore, a number of interrupters may be contained in a common tank or vessel filled with insulating fluid medium, the interrupters being connected in series between the terminals of one phase of the circuit-breaker. All the interrupters may be operated by the same operating mechanism.

What we claim as our invention and desire to secure by Letters Patent is:

1. A high-voltage circuit-interrupter for operation within an enclosure containing an insulating fluid medium which comprises a fixed contact having a bore and a relatively movable contact assembly wherein the movable contact assembly is axially movable relative to the fixed contact and comprises an insulating nozzle, a generally tubular main electrical contact within the nozzle, an auxiliary contact positioned within the interior of the main electrical contact and movable axially within the main contact by a biased spring, there being at least one radial passage extending through to the interior of the contact assembly, and the interrupter further including means for withdrawing the contact assembly relative to the fixed contact to separate them and draw an arc between them; means for delivering insulating liquid under pressure to the nozzle so as to create a flow of the said fluid through the nozzle during te said withdrawal, the nozzle being constructed and arranged to direct said flow inwardly into a gap formed between the separated fixed contact and contact assembly; means for moving the auxiliary contact relative to the main electrical cntact during the said withdrawal so that the auxiliary contact carries the arcing current, the auxiliary contact further containing a central rooting electrode which is movable with the auxiliary contact relative to the main electrical contact, said rooting electrode being fixed by a hollow spider to the auxiliary contact and having a gas deflecting portion, said auxiliary contact cooperating with said main contact to constitute valve means, said valve means being operable to permit a first part of the said fluid flow to vent through a port in the auxiliary contact into said radial passage in the movable contact assembly after passing inwardly into the said gap and being deflected by said gas deflecting portion of the rooting electrode towards said radial passage, another part of the said flow escaping through the bore of the fixed contact after passing inwardly into said gap, and in which the said movement of the auxiliary contact relative to the main electrical contact on operation of the circuit-breaker is arranged to operate said valve means so as to permit said radial venting.

2. A circuit-interrupter as claimed in claim 1 in which the means for delivering fluid under pressure to the nozzle comprises a puffer device of piston and cylinder type, the puffer cylinder being secured to the nozzle so as to deliver fluid under pressure into the nozzle and the puffer piston being fixed, the main electrical contact of the moving contact assembly being secured to the puffer cylinder and nozzle for movement therewith, and said radial passage being external to said puffer cylinder.

3. A circuit-interrupter as claimed in claim 2 in which the current path through the interrupter when in the closed position is from the fixed contact to the main electrical contact and thence to the puffer cylinder, and after an initial stage of the opening stroke, the current path is from the fixed contact to the auxiliary contact, and thence via the main contact in series with the auxiliary contact to the puffer cylinder.

4. A puffer-type interrupter as claimed in claim 2 in which the auxiliary contact comprises a generally cylindrical body having a radially-open port in its wall, said radially open port capable of being in alignment with the radial vent passage in the moving contact assembly.

5. A puffer-type interrupter as claimed in claim 2, which is housed within a vessel containing an insulating medium, the electrical connection to the movable contact assembly provided by spring transfer contacts fixed to a support-contact ring, the free-ends of the spring transfer contacts being in surrounding electrical contact with the puffer cylinder wall and maintaining electrical contact while the cylinder wall is movable axially during the opening or closing action of the interrupter.

6. A high voltage circuit-interrupter for operation within an enclosure containing an insulating fluid medium comprising a fixed contact having a bore, a fixed support structure having a bore on generally the same axis as the fixed contact and spaced therefrom including a puffer type piston, a hollow driving tube axially movable within the bore of the fixed structure and thus axially movable relative to the fixed contact, the driving tube adapted to be driven by external driving means, the driving tube including a stop means within the bore and carrying a puffer type cylinder capable of cooperating with said puffer type piston to create a flow of insulating fluid medium, a contact assembly on an end of said driving tube and adjacent to the fixed contact, the contact assembly comprising an insulating nozzle adapted to surround said fixed contact, and a generally tubular main electrical contact within the nozzle, said contact assembly having a radial passage extending from exterior of the contact assembly through to the interior of the main electrical contact, the interrupter further including a tubular auxiliary contact positioned within the main electrical contact and axially movable relative to the main electrical contact and relative to the hollow driving tube by a biased spring carried within the hollow driving tube, the auxiliary contact having a port capable of aligning with said radial passage in said contact assembly, having stop means engagable with the stop means of the driving tube, and having a rooting electrode fixed within the auxiliary contact by a spider, the rooting electrode having a gas deflecting portion closing the hollow driving tube, whereby upon initial axial movement of the contact assembly from a position surrounding the fixed contact caused by an external driving means, the auxiliary contact maintains electrical contact with the fixed contact by the action of the biased spring and the movement of the puffer cylinder and piston relative to each other increases the pressure in the fluid medium within the contact assembly around the fixed contact and the main contact and whereby upon further movement of the contact assembly away from the fixed contact, the auxiliary contact separates from the fixed contact by means of the stop means of the auxiliary contact engaging the stop means of the driving tube and the port in the auxiliary contact and the radial passage in the contact assembly align so as to allow fluid medium flow driven by said pressure increase inwardly into a gap formed between the separated fixed contact and auxiliary contact and through the bore of said auxiliary contact and be deflected by the gas deflecting portion of the rooting electrode into the radial passage of the contact assembly and thereby provide radial venting of the interrupter through a low-impedance radial venting path external to the puffer piston and cylinder and in close proximity to the contacts.

* * * * *